US007455475B2

(12) United States Patent
Plasonig et al.

(10) Patent No.: US 7,455,475 B2
(45) Date of Patent: Nov. 25, 2008

(54) METHOD FOR APPLYING ELEMENTS TO SURFACES OF CONSTRUCTED OBJECTS USED FOR ROAD TRAFFIC

(75) Inventors: Gerhard Plasonig, Zürich (CH); Christoph Niederhauser, Münchenbuchsee (CH)

(73) Assignee: Woodwelding AG, Zug (CH)

( * ) Notice: Subject to any disclaimer, the term of this patent is extended or adjusted under 35 U.S.C. 154(b) by 351 days.

(21) Appl. No.: 11/354,557

(22) Filed: Feb. 15, 2006

(65) Prior Publication Data

US 2006/0193689 A1 Aug. 31, 2006

Related U.S. Application Data

(63) Continuation-in-part of application No. 10/499,901, filed as application No. PCT/CH02/00721 on Dec. 23, 2002, now abandoned.

(30) Foreign Application Priority Data

Dec. 24, 2001 (CH) ..... 2340/01

(51) Int. Cl.
*E01C 23/16* (2006.01)

(52) U.S. Cl. ..... 404/72; 404/73; 404/93

(58) Field of Classification Search ..... 404/12–16, 404/77, 79, 95, 72, 73, 93
See application file for complete search history.

(56) References Cited

U.S. PATENT DOCUMENTS 4,102,718 A 7/1978 Eigenmann
4,237,191 A * 12/1980 Horne ..... 359/551
4,376,007 A 3/1983 Eigenmann
4,428,320 A * 1/1984 Oplt et al. ..... 116/63 R
4,584,044 A 4/1986 Tokunaga et al.
4,913,772 A * 4/1990 Taylor et al. ..... 156/499
4,990,024 A 2/1991 Eigenmann
5,393,559 A 2/1995 Shoesmith et al.
5,447,592 A 9/1995 Berce et al.
5,667,334 A 9/1997 Boyce
5,772,359 A 6/1998 Marty
5,853,263 A * 12/1998 Green ..... 404/94
6,059,488 A 5/2000 Green
6,334,734 B1 1/2002 Attar
6,576,074 B1 6/2003 Cabrera et al.
2002/0100534 A1 8/2002 Distel

* cited by examiner

*Primary Examiner*—Raymond W Addie
(74) *Attorney, Agent, or Firm*—Rankin, Hill & Clark LLP

(57) ABSTRACT

An environmentally sound method for applying or fixing elements (2) to constructed objects used for road traffic. The element (2), which is at least partially made of a material that can be liquefied by mechanical energy, is positioned on the surface, is pressed against the surface, and is simultaneously subjected to a local mechanical stimulation to liquefy the liquefiable material, and the element (2) binds with the surface upon re-solidifying. A mobile device (1) for applying elements (2) of this type, includes device that can travel via rolls or rollers (4, 5) and that is provided with at least one oscillating unit (10) including a sonotrode (6), a converter (7) and of an amplifier (8), and with a generator (9). The element (2) may be a marking or signaling element to be applied to roads or tunnel walls.

7 Claims, 5 Drawing Sheets

METHOD FOR APPLYING ELEMENTS TO SURFACES OF CONSTRUCTED OBJECTS USED FOR ROAD TRAFFIC

This application is a continuation-in-part of prior application Ser. No. 10/499,901 filed on Jul. 12, 2004, now abandoned, which in turn is a national phase filing of PCT/CH02/00721, filed on Dec. 23, 2002, which in turn claims priority to Swiss Patent Application 2340/01, filed on Dec. 24, 2001.

BACKGROUND OF THE INVENTION

The invention relates to a method according to the preamble of the first patent claim. The method serves for attaching or fastening elements on surfaces of construction objects in the road traffic field, for example for attaching marking elements or signalling elements on roads or squares, in garages or multi-storey car parks or on house or tunnel walls, that is to say on surfaces which in particular consist of asphalt or concrete. The invention also relates to a device for carrying out the method and to an element being able to be attached with the method, according in each case to the preambles of the respective patent claims.

Known methods for attaching for example markings onto road surfaces are essentially based on two different processes, namely a process of thermally creating a material fit and a process of chemically creating a material fit.

According to a method of the first group, thermoplastic strips and the asphalt surface lying below this are melted down with a gas flame, so that the molten materials bond to one another after cooling. The disadvantage of this method lies in the fact that on the one hand a very large volume of the road surface needs to be heated and on the other hand the method is very time consuming due to the long heating-up and cooling-down phases. Furthermore the energy requirement is very high and the melting process is difficult to control and therefore little suited for automation. Handling of naked flames and gas containers furthermore entails safety risks and is therefore connected with an increased handling effort.

According to a method of the second group, solvent-containing coatings of paint are sprayed onto the designated surface. For this method the surface needs to be thoroughly cleaned prior to being coated, and then the marking geometries need to be covered or suitable stencils need to be positioned. Sprayed markings are deposited however only in a very superficial manner and, due to wear and abrasion, have mostly only a short serviceable life. Furthermore, during application or during abrasion of the coats of paint, solvent, colour particles and other partly noxious substances get into the environment. It is further known to attach premanufactured markings to surfaces using adhesives, such attaching having the same disadvantages as discussed above.

It is the object of the invention to provide a method for permanent or temporary attachment of elements to surfaces of construction objects in the road traffic field, i.e. to surfaces which in particular consist of asphalt or concrete.

BRIEF SUMMARY OF THE INVENTION

According to the invention the elements, for example marking or signalling elements consist at least partly of a material which is liquefiable by way of mechanical excitation, e.g. of a thermoplastic material. This means that the element consists of a material with at least one liquefiable (e.g. thermoplastic) component, or at least a region of the element to be directed towards the surface on which it is to be attached consists of such a material. The element is positioned on the surface on which it is to be attached and then it is at least locally pressed against the surface and mechanically excited in a manner such that the liquefiable material is liquefied at least locally and temporarily, and after re-solidification forms a bond between the surface and the element. The surface onto which the element is pressed may also be partly liquefied by the mechanical excitation. The mechanical excitation is usually based on excitation by a sonotrode (piezoelectric excitation for higher frequencies, magnetostrictive excitation for lower frequencies). The excitation is preferably based on mechanical oscillation at a frequency lying in the range of ultrasound, and as the case may be also at lower frequencies. The frequencies are selected depending on the field of application. By way of varying the frequency the extent to which the liquefiable material and, as the case may be, surrounding regions (background) are liquefied or heated may be determined. The amplitude, the frequency and the excitation duration influence the extent of liquefaction and heating. A further essential aspect is the way in which the mechanical oscillation is coupled into the element to be attached or into the element region which is to be liquefied respectively. For such coupling, the element may e.g. be made to be part of the oscillating body. By partially liquefying and subsequent re-solidification, advantageously combined with simultaneous pressing, a bond is produced between the element and the surface on which the element is to be attached.

According to the invention the energy used for liquefying the liquefiable material is introduced in a locally and temporally controlled manner. By way of this locally and temporally controlled application of energy, adjacent regions are not unnecessarily heated, which fact creates various advantages. On the one hand the bond can be created using considerably less energy. All the same, the resulting bond, due to the way and manner in which it is created, is extremely lasting and has a high loading capacity. On the other hand the bond can be created in considerably less time since considerably less time is required for introducing the required energy. The method according to the invention is also environmentally friendly since no further auxiliary agents such as adhesives, solvents or other bonding agents comprising noxious substances are used.

The strength of the bond is influenced by the intensity of the mechanical energy (impulse, frequency) and/or the excitation duration. According to the field of application it is thus possible to create bonds which are very lasting, or which may be easily detached again. By way of longer excitation duration or by way of a more intense excitation as a result of a higher frequency or amplitude, a stronger bond is achieved, because e.g. more material is liquefied.

The method according to the invention is suitable for the most varied applications in the field of road traffic, as for example in road construction, realisation of signs or markings, sealing of gaps, etc. Amongst other things the method is suitable for attaching marking strips or marking images which for example are supplied in the form of suitably punched films and are for example attached to the surfaces of streets or tunnel walls, e.g. stripes marking middle or edge of roads, arrows or lettering.

The method according to the invention is also suitable for applying signalling elements which are to project functionally beyond the surface on which they are attached. Such signalling elements are for example to be understood as elements which are to be attached in the region of the centre line or an edge line of a road and which elements when driven across notify the driver by vibrating his vehicle. When required, such elements may be designed reflecting so that they may be better seen particularly in poor light conditions.

In particular on motorways these elements may be designed such that they have properties which are different with respect to direction. One example of such an element reflects white in the travel direction and red in the opposite direction. By way of this a person driving on the wrong side of the road is made aware of his mistake. Other designs are also possible.

The method according to the invention is particularly suitable for fastening elements which are fabric-like or are based on a film material. These in particular are middle lines and side lines on roads, markings for pedestrian crossings, stop lines, direction indicators (arrows) etc. The elements may be quasi endless (continuous lines) or limited. The film material of such elements advantageously comprises a two-dimensional or net-like substrate film which for example is provided with a coating being liquefiable by way of mechanical excitation. This mechanically liquefiable coating is provided on the one side of the substrate to be directed towards the road surface and it is even or comprises projecting elements which serve as energy directors, i.e. for concentrating the exciting mechanical energy in a manner such that a locally intensified melting-down occurs.

The side of the elements to be directed towards the surface on which the element is to be attached may be coated with a liquefiable material only in regions. Instead of the coating, three-dimensional regions of the liquefiable material may be provided, for example pins, rings or other shapes, which are for example uniformly distributed over the surface of the element to be attached to the road surface or other surface. The position of such three-dimensional shapes is suitably marked on the opposite side from which the mechanical oscillation is coupled in, so that the mechanical energy may be selectively introduced in the correct locations.

A further field of application of the method according to the invention is the fastening of reinforcements to surfaces of construction objects in the field of road traffic. From the state of the art there are known methods with which bridges, in particular bridges of concrete are restored by attaching strips of high-tensile, stiff fibres (e.g. carbon fibres) on the lower bridge side, i.e. in the region in which the structure is loaded in tension,. Such strips relieve the bridge structure or allow it to be more loaded. According to the state of the art such strips are attached by way of adhesive which is a cost-intensive and thus expensive method. It is furthermore not very suitable due to environmental aspects. On attaching the strips, the fibres must be prestressed so that the structure is relieved in an effective manner from the very beginning. However prestressing is not linear but must be greatest along the middle and lowest along at edges of the bridge. Using the method according to the invention, it becomes possible to process the above described reinforcement strips very simply and also inexpensively in a continuous process. The reinforcement strips are pressed onto the surface of the construction object to be reinforced, they are prestressed depending on location and are then connected to the surface by way of mechanical excitation and pressure. Since the connection is created in a very short time, non-linear prestressing ensuring optimal results is easily possible.

The bonds created with the method according to the invention may be permanent or may be only temporary. Temporary bonds are to be understood as bonds which are only to be present for a forseeable time duration. Such bonds make sense, in particular in the field of building sites where it is necessary to divert the traffic for a certain time. Such bonds are created in a very simple manner and they can be easily detached later. In the field of building sites it makes particular sense to attach temporary markings which comprise a film, for example in the form of an endless tape as a base structure and which comprise a coating being able to be bonded to the road surface by way of mechanical excitation. Using a suitable device, endless or limited signalling elements may be attached very simply in a continuous process. In order to detach the elements the same device may be used in a reverse way and manner (new liquefaction, detachment and then removal). The bonds may be formed such that the strips can be detached without special tools. Pretreatment of the surface on which the elements are to be attached, e.g. for drying such surfaces, may be effected by preheating the surface by e.g. using a hot roller which is more suitable than a gas flame. In certain cases such pretreatment (drying, priming) may not be required. The method may be applied for various element thicknesses and element geometries. Other than in the known melt-on processes, the material thickness can be optimized. The time required for the mechanical excitation may be reduced and the bonding improved by way of preheating. Bonds created according to the invention are characterised by their good adhesion on the most varied of porous surfaces. They display a good resistance to specific influences such as weather, wear, etc.

Since the method has no influence on the geometry of the element to be fastened, customer-specific geometries can be realized, as well as customer-specific surface structures and colourings. A surface structure may be embossed during attaching by the tool used for attaching or by a subsequent tool. This surface structure may assume additional functions, e.g. creating noise when in contact with a rotating tyre, so that the driver is made aware that he is crossing the marking.

The advantages of the method according to the invention may be summarized as follows:

Carrying out the method is extremely simple and gives high performance at low operating and maintenance expense;

Good bonding between the attached element and the surface on which it is attached is achieved due to liquefaction of a part of the material during the fastening procedure;

Improved bonding with respect to known methods using an open gas flame is achieved, due to the fact that no incineration occurs and no soot particles contaminate the bonding surfaces;

Very short process times (time for mechanical excitation and for resolidification or cooling) are possible;

The device for attaching the elements does not need to carry liquid, volatile or inflammable substances, which fact considerably increases the working safety;

The method is environmentally friendly since above all no volatile substances or auxiliary agents are applied.

In combination with the following Figures the method according to the invention and some exemplary embodiments of devices for carrying out the method according to the invention, and of elements being attachable on construction objects using the method are described in more detail.

DETAILED DESCRIPTION OF THE INVENTION

Figure 1:
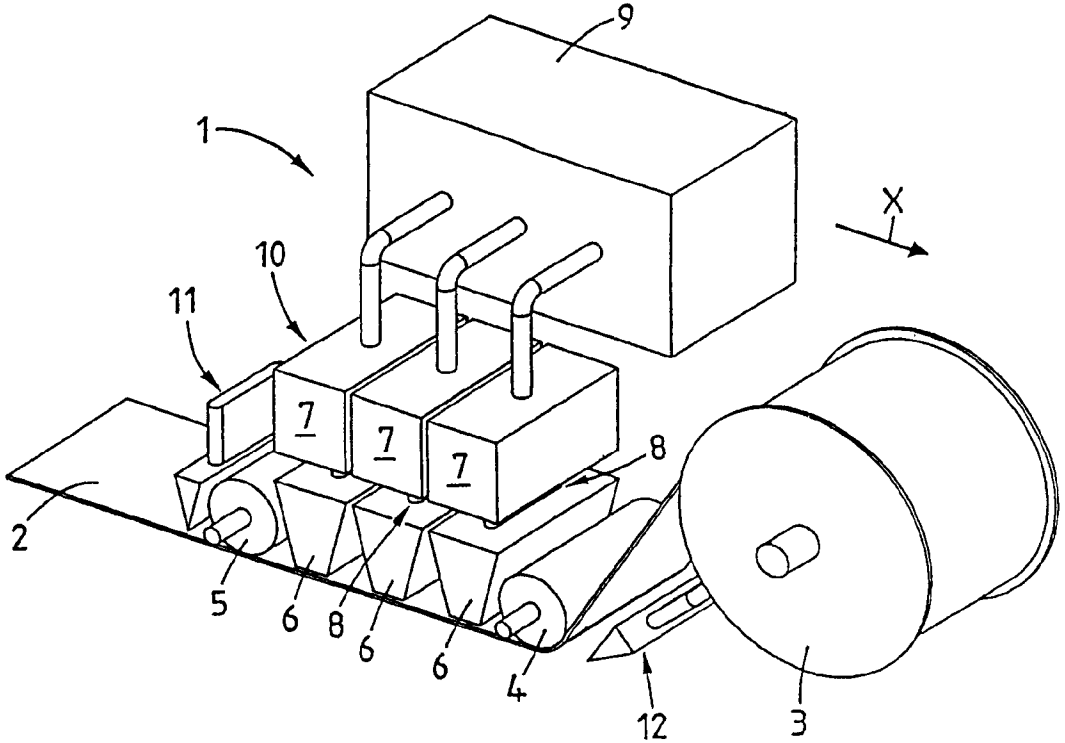
FIG. 1 is a perspective view of a first embodiment of a device for attaching marking strips.
Figure 1:
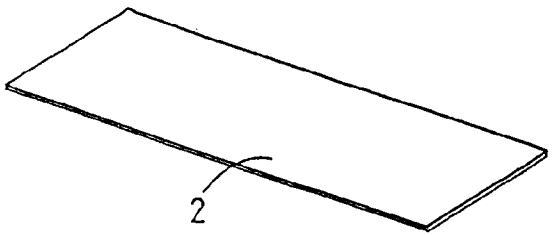

FIG. 1, in a greatly simplified manner, shows the essential elements of a first embodiment of a fastening device for attaching an element 2, for example a marking element (marking strip) on the surface of a road, for example of asphalt or concrete. The element 2 to be attached is strip-like and is separated from a tape, wherein the tape is rolled on a supply reel 3. The element 2 for example comprises a substrate material which is coated on at least one side. It is for example a strip of plastic or metal film being coated with a material which can be melted down using mechanical excitation. This meltable or liquefiable material is for example a thermoplastic polymer material (e.g. polypropylene). The element 2 may also consist completely of the meltable material.

While the fastening device 1 is moved in the working direction tape for the element 2 is rolled from the supply reel 3 and by way of a first roller 4 is pressed onto the surface (e.g. road surface) on which the element 2 is to adhere. The working direction is shown by an arrow X. Behind the first roller 4 three sonotrodes 6 are provided being actively connected to a converter (sound transducer) 7 and to a mechanical amplifier 8. The converter 7 which serves for converting electrical into mechanical oscillation is driven via a generator 9. The converter usually comprises piezoelements converting electrical oscillation with typical frequencies above 20 kHz into suitable mechanical oscillation. The working range of the converter is selected to suit the application. Normal frequencies lie in the range between 2 kHz and 400 kHz.

The amplifier 8 functions as a mechanical amplifier due to its configuration. It transforms oscillation, concentrates this oscillation and transmits it to the sonotrode 6. The sonotrode 6 together with the amplifier 8 and the converter 7 forms an oscillating unit 10. The elements of the oscillating unit 10 are optimised to the field of application or to a frequency and preferably oscillate in resonance. The oscillating unit 10 excites into oscillation the element 2 and where appropriate the material of the surface to which the element 2 is to be attached. Through internal and external friction caused by the excitation, the element is melted, at least locally, and as the case may be, the surface material too. Due to high shear effects a high degree of plastification is achieved. The element 2 is advantageously pressed (roller 5) against the surface on which it is to be attached during liquefaction and afterwards, so that after resolidification the element and the surface are connected to one another. The shown fastening device 1 comprises three oscillating units 10. These may be activated individually. It is of course to be understood that a device may have a different number of oscillating units.

Behind the three oscillating units 10 there is a second roller 5 which presses the element 2 against the surface during the cooling. The first and the second rollers 4, 5 serve preferably for setting the distance between the sonotrodes 6 and the element 2. The fastening device 1 serves for fastening the element 2 in a continuous or in a discontinuous process.

A cutting device 11 is arranged behind the second roller 5. This device serves for cutting off the element 2 if the marking strip to be deposited is not continuous as is shown. The discontinuous case is indicated schematically in FIG. 1 by a first element 2 of a marking tape being shown behind the fastening device. In front of the first roller 4 there is a detaching device 12 which serves for detaching elements 2 from a surface on which they have previously been attached, following re-liquefaction of the element by the oscillating units.

The type of the oscillation and the manner of its coupling into the element 2 to be fastened is determined by the shape of the sonotrode 6 and the other elements of the oscillating unit. Preferred are elongate or cylindrical shapes which extend over the whole width of the element 2 and taper downwards, i.e. towards the element 2 to be treated.

Figure 2:
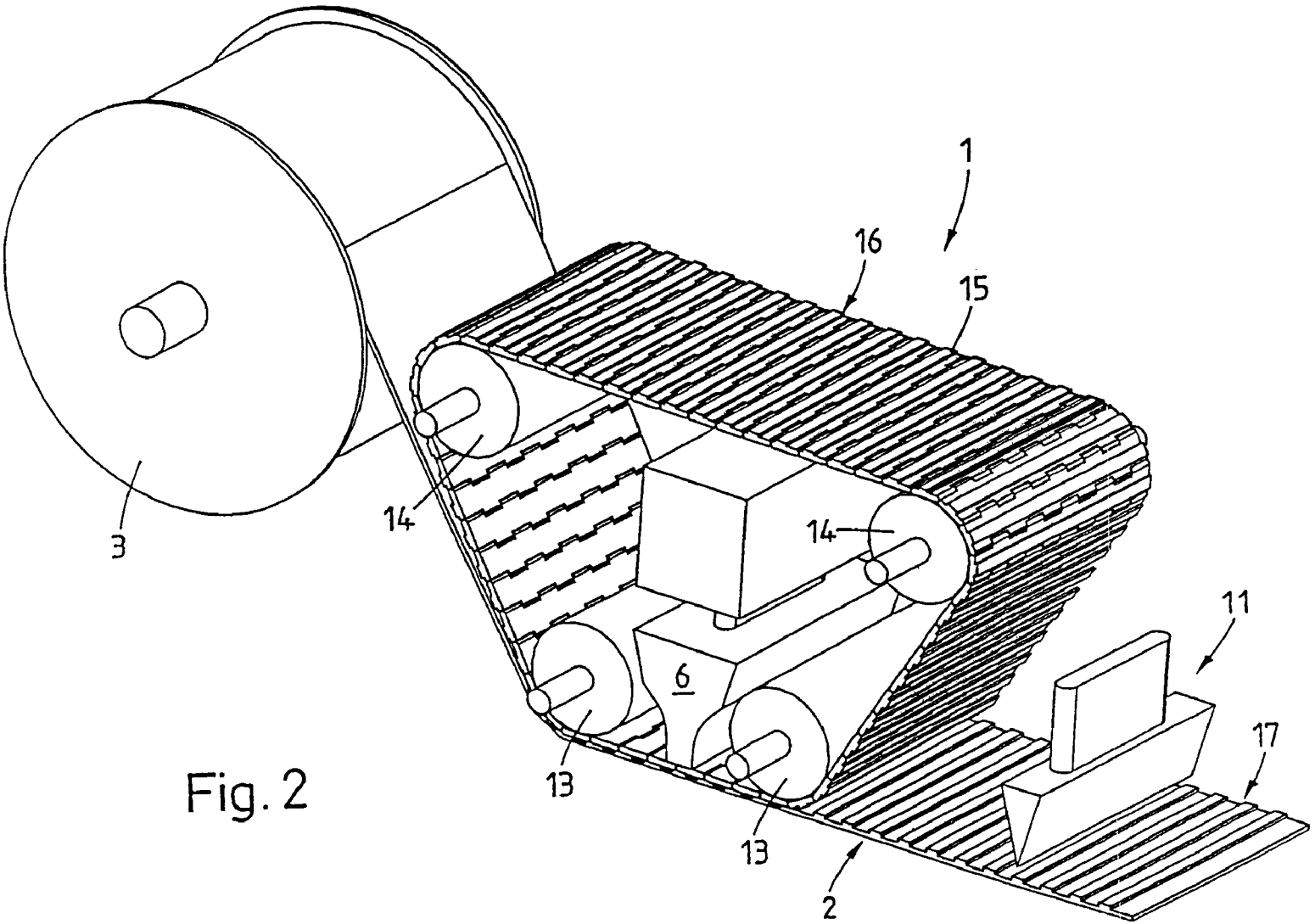
FIG. 2 is a perspective view of a second embodiment of a device for attaching marking strips, the device comprising a link chain.

FIG. 2 shows a further embodiment of a fastening device 1 for attaching an element 2 to a surface. The fastening device 1 comprises two lower rollers 13 and two upper rollers 14 which serve for guiding a circulating link chain 15. The link chain 15 on its outer surface has an embossing structure 16 which serves for embossing a surface structure 17 into the element 2. A sonotrode 6 is arranged between the two lower rollers 13 and serves for the indirect excitation of the element 2 via the link chain 15. The element 2 being processed is arranged between the link chain 15 and the surface on which it is to be attached. The tape-like material for the element 2 is stored on a supply reel 3 and is pulled from this during the process. A cutting device 11 serves for cutting off an element 2 of material on the supply reel 3. This cutting device may be arranged in front of or behind the link chain 15. Different surface structures may be embossed into the element 2 by way of using link chains 15 with different embossing structures 16.

For driving the fastening device 1, preferably electrical or hydraulic motors (not shown in detail) are used. The fastening device 1 is designed preferably self-travelling or may be used as a part of another machine. For processing differently shaped elements 2 it has a corresponding configuration.

Figure 3:
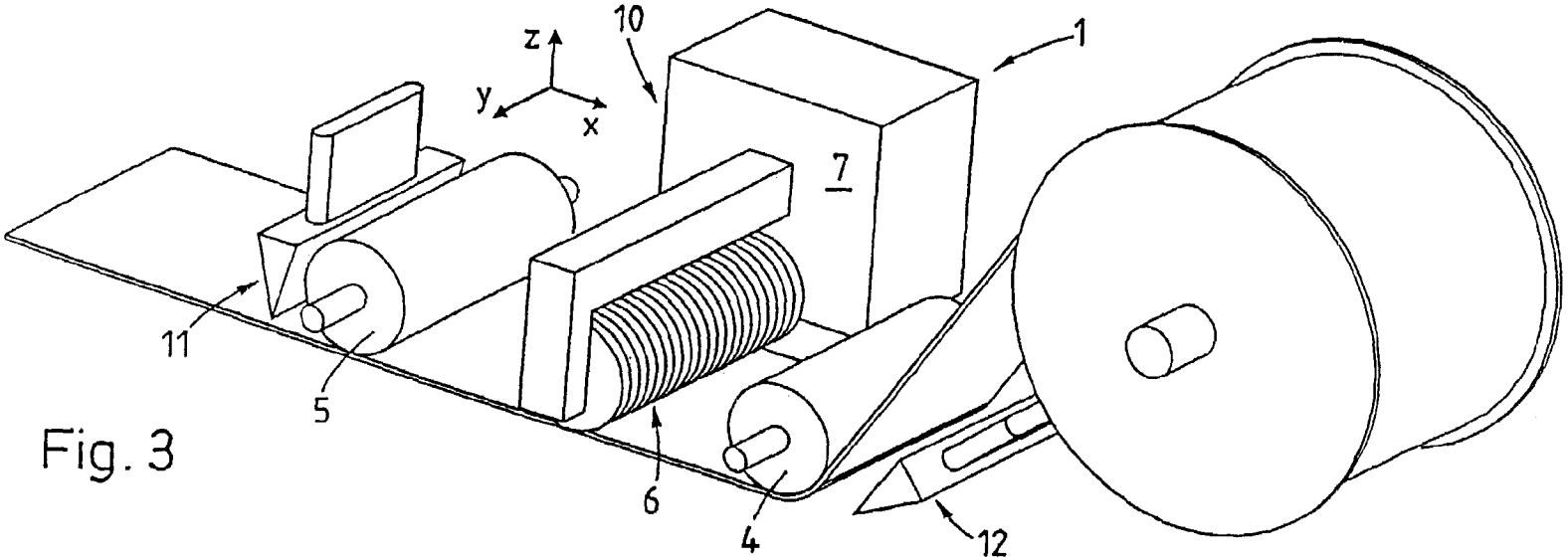
FIG. 3 is a perspective view of a third embodiment of a device for attaching marking strips, the device comprising a sonotrode roller.

FIG. 3 shows a further embodiment of a fastening device 1 for attaching elements 2 on a surface. The fastening device 1 comprises an oscillating unit 10 with a rotating sonotrode 6. The sonotrode 6 is designed as a sonotrode roller which is preferably excited by a converter 7 to oscillate in a radial direction. The oscillation is transmitted to the element 2 and has the effect that this element is plastified locally. Rollers 4, 5 are arranged in front of and behind the sonotrode roller 6 in the working direction (x-direction). These rollers serve for pressing the element 2 onto and into the surface of the background. If applicable, rollers 4, 5 are also guiding and support rollers. A cutting and detaching device 11, 12 are arranged in front of and behind the rollers. These devices comprise a blade each and when activated cut off the element 2 or detach it from the surface on which it is fastened.

Figure 4:
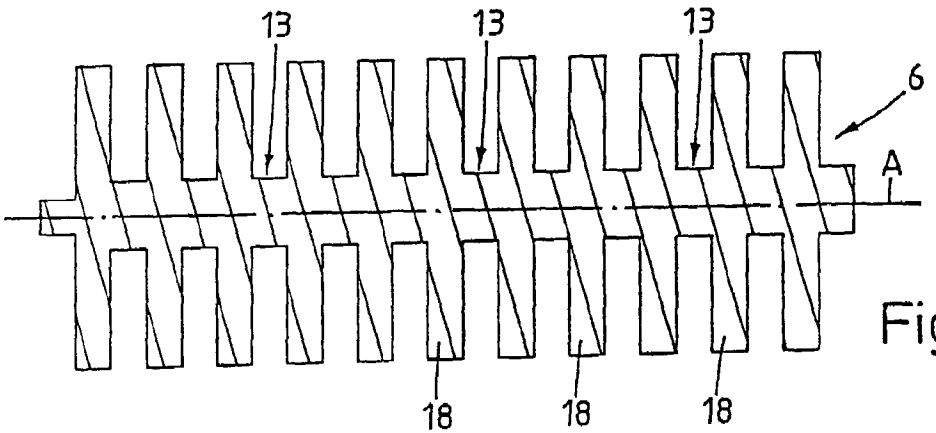
FIG. 4 is a cross-sectional view a section through a sonotrode roller.

FIG. 4 shows a schematic section along the axis of the sonotrode roller 6 according to FIG. 3. As may be recognised, the sonotrode roller 6 consists of a plurality of stacked disks 18 being connected to one another centrically via thin locations 13. The oscillation of the converter 7 is preferably introduced perpendicularly to the axis A of the sonotrode roller.

The invention may be summarized as follows: an environmentally friendly and safe method for attaching or fastening elements on surfaces of construction objects in the field of road traffic which method comprises: positioning the element to be attached on the surface on which it is to be attached and liquefying the element by local mechanical excitation during an excitation time so that the element on its side facing the surface and where appropriate also the surface onto which the element is pressed is locally melted in a manner such that after cooling the element is fastened on the surface. A travelling device for attaching a marking strip for example onto the surface of a road comprises a means being capable of travelling on rolls or rollers 4, 5, and further comprising at least one oscillating unit 10 consisting of sonotrode 6, converter 7 and amplifier 8 and a generator 9. The marking strips attached onto the surface of the road apart from their colouring may have a profiling which produces acoustic or various optical signals, such as e.g. white reflection in the one direction and red reflection in the other direction.

FIGS. 5 to 8 show further elements 2 which may be attached to surfaces of construction objects according with the method according to the invention. These elements are discrete elements which may not be wound off from a supply reel. They may however be positioned in a per se known manner at predefined time intervals below the oscillation tool of a fastening device moving at a constant speed for example along a road, so that they are deposited onto the road surface at constant distances to one another. The elements may also be attached individually with a hand apparatus known from ultrasonic welding or with a similar apparatus.

Figure 5:
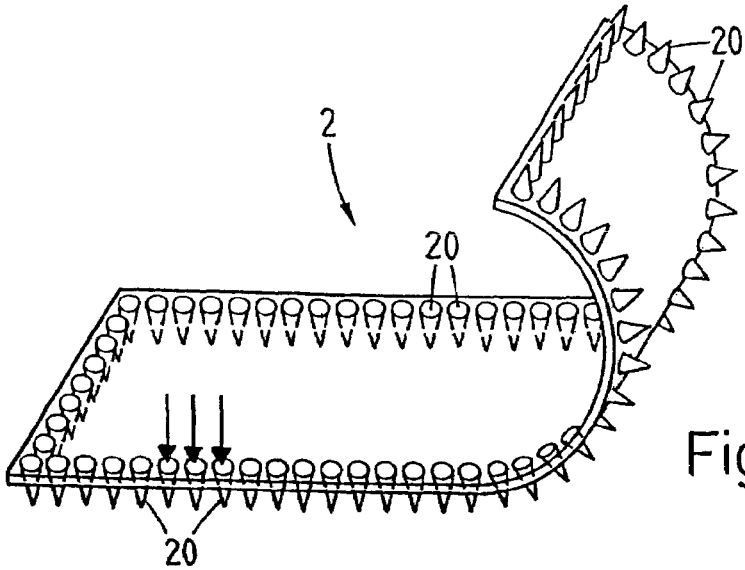
FIGS. 5 to 8 show further examples of elements which are attachable to surfaces of construction objects of road traffic using the method according to the invention.

FIG. 5 shows a flat element 2 which is shown to be rectangular, but which however may have any shape. The element along the edge comprises nubs 20 arranged on the one element side which is to be directed towards the surface on which the element is to be attached. At least these nubs consist of the liquefiable material, where appropriate the whole edge region or the nub-side of the edge region consist of this material. For the attachment process, the element according to FIG. 5 is positioned and is pressed against the surface and simultaneously excited (e.g. with an excited sonotrode) at least in its edge region (indicated by arrows).

Figure 6:
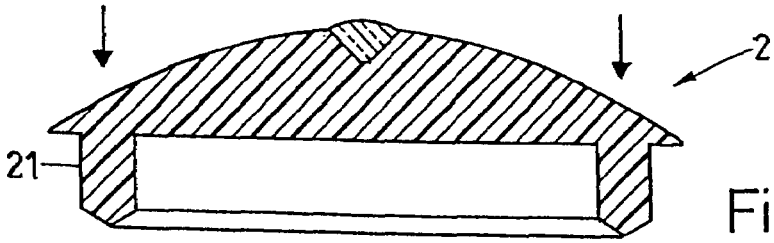

The element 2 according to FIG. 6 is disk-like and for example comprises a reflector in the middle of its side facing outwards. On its opposite side which is to be directed towards the surface on which the element is to be attached, the element 2 comprises a fastening ring 2. In the region of this ring 21 the element is excited from the outside, as this is illustrated by the arrows, and is pressed against the surface, for example with a corresponding tubular sonotrode. The fastening ring 21 may also be formed by a row of pins or nubs arranged along the edge of the element 2. At least the fastening ring 21 or the pins or nubs serving the same purpose, or where appropriate the whole element 2 consist of a material which is liquefiable by way of mechanical oscillation.

Figure 7:
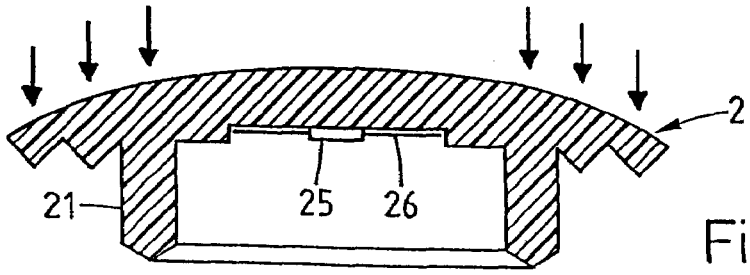

FIG. 7 shows a disk-like element similar to the element of FIG. 6. An electronic module 25 with an aerial 16, as is used for traffic directing or controlling systems, is fastened within a fastening ring 21 on the bottom side facing the road surface on which the element is to be attached. On pressing the element on the road surface with the aid of a tubular sonotrode adapted to the fastening ring 21 (as illustrated by the arrows) the material of the fastening ring 21 is at least partly liquefied and pressed into the road surface to create a hermetically closed space for the electronic module. As illustrated in FIG. 7, the fastening ring may have an inner region and an outer region wherein the inner region protrudes further from the bottom side of the element. For attaching this element to the road surface, it is positioned within an opening provided in the road surface and adapted to the inner ring region, such that on fastening the element on the road surface, the inner ring region is attached to the bottom of the opening and the outer ring region is attached to the road surface around the opening. The element 2 according to FIG. 7 may of course also have a shape other than a disk-like shape.

Figure 8:
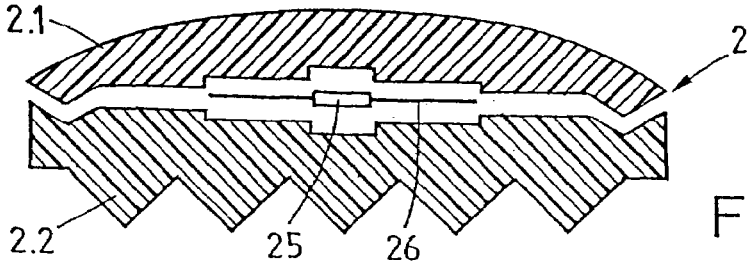
Figure 9:
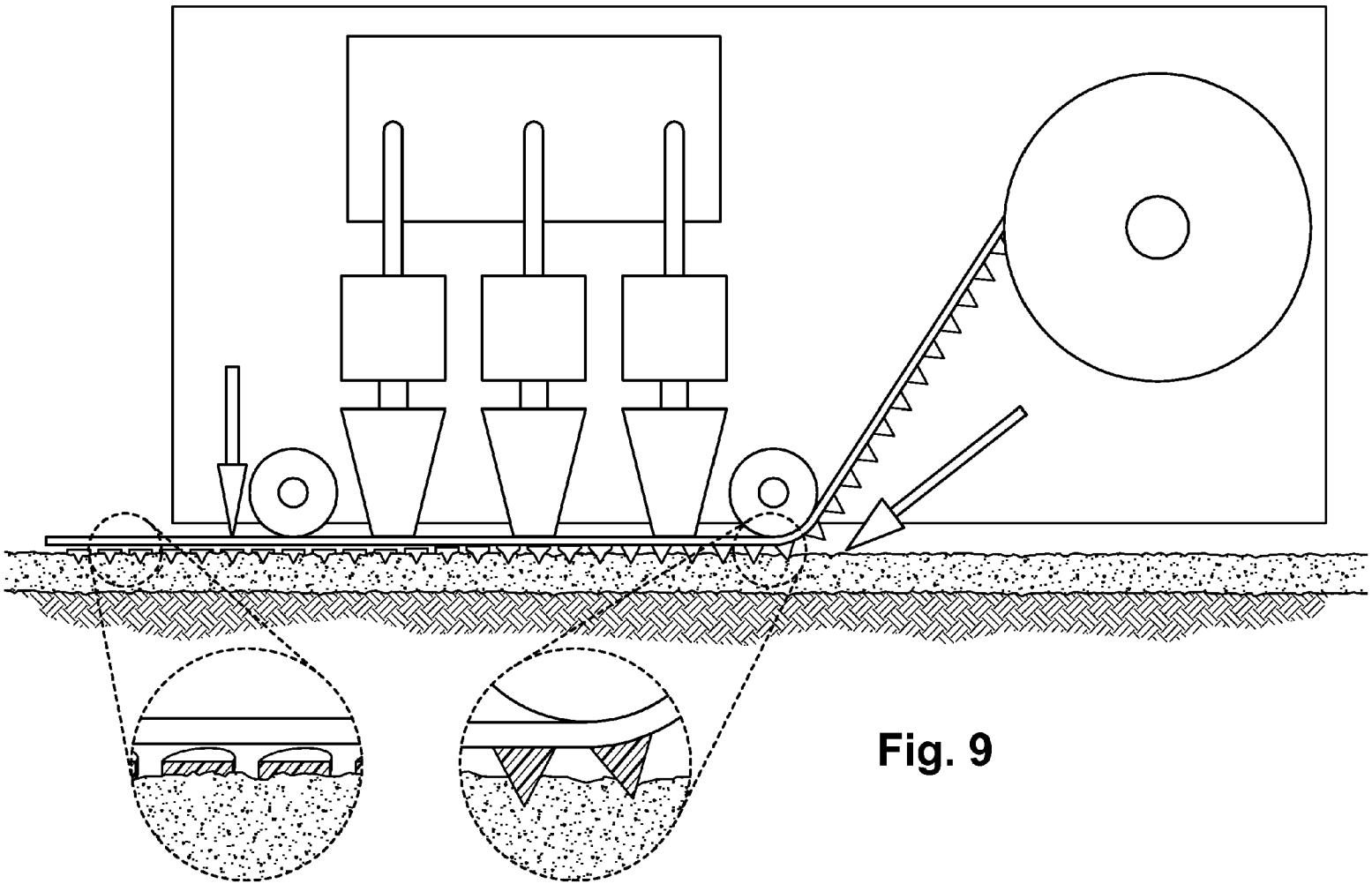
FIG. 9 is a side elevational view of the first embodiment of the device in the process of attaching marking strips to readway.

FIG. 8 shows a further element with an integrated electronic module 25 comprising an aerial 26. Module and aerial are positioned in a hermetically closed space formed between two element parts 2.1 and 2.2, wherein these two element parts may for example be connected to one another on fastening of the whole element. The element part 2.2 facing towards the fastening side of the element consists at least partly of the liquefiable material and comprises energy directors e.g. in the form of at least one ring. The two element parts 2.1 and 2.2 may also be connected to one another e.g. by an adhesive prior to attachment of the element to the road surface. It is also possible to integrate the electronic module into the element during already on manufacturing of the element 2 by e.g. moulding.

What is claimed is:

1. A method for fastening an electronic module with an aerial to a road surface comprising the steps of:

providing an element comprising a bottom side and a top side and a fastening ring protruding from the bottom side, the fastening ring comprising a material being liquefiable by mechanical excitation, providing an electronic module with an aerial, providing a device comprising an oscillating unit and a tubular sonotrode connected to the oscillating unit and being adapted to the fastening ring, fastening the electronic module to the bottom side of the element within the fastening ring, positioning the element with the electronic module and the aerial fastened thereto on the road surface with the bottom side facing towards the road surface, pressing the element onto the road surface by pressing the oscillating sonotrode onto the element thereby liquefying the liquefiable material at least partly and pressing it into the road surface thereby fastening the fastening ring to the road surface and forming a hermetically closed space for the electronic module.

2. The method according to claim 1, wherein the fastening ring comprises an inner region and an outer region, the inner region protruding further from the bottom side of the element than the outer region, wherein an opening is provided in the road surface adapted to the inner ring region and wherein the inner ring region is positioned in the opening and is fastened to the bottom of the opening and the outer ring region is fastened to the road surface around the opening.

3. The method according to claim 1, wherein the device with the oscillating unit and the sonotrode is an ultrasonic device.

4. A method for fastening an electronic module with an aerial to a road surface comprising the steps of:

providing an element comprising a first part and a second part, the two parts forming a space therebetween and the second part, on its side opposite the space, comprising a material being liquefiable by mechanical excitation and energy directors, providing an electronic module with an aerial, providing a device comprising an oscillating unit and a sonotrode adapted to the top part, positioning the electronic module with the aerial into the space between the first and the second part, closing the space hermitically by fixing the first part to the second part, positioning the two element parts with the electronic module and the aerial therebetween on the road surface with the second part facing towards the road surface, and pressing the element onto the road surface by pressing the oscillating sonotrode onto the first element thereby liquefying the liquefiable material of the second part at least partly and pressing it into the road surface such fastening the bottom part to the road surface.

5. The method of claim 4, wherein the step of closing the space hermetically is carried out together with the step of pressing the element onto the road surface.

6. The method according to claim 4, wherein the step of closing the space hermetically is carried out prior to the step of pressing the element onto the road surface.

7. The method according to claim 4, wherein the device with the oscillating unit and the sonotrode is an ultrasonic device.

* * * * *